US011142428B2

(12) United States Patent
Yu

(10) Patent No.: US 11,142,428 B2
(45) Date of Patent: Oct. 12, 2021

(54) SCARF-JOINT STRUCTURE FOR THE PAPER TUBE OF A FILM DISPENSER

(71) Applicant: Yang Bey Industrial Co., Ltd., Taichung (TW)

(72) Inventor: Teng-Chi Yu, Taichung (TW)

(73) Assignee: Yang Bey Industrial Co., Ltd., Taichung (TW)

( * ) Notice: Subject to any disclaimer, the term of this patent is extended or adjusted under 35 U.S.C. 154(b) by 88 days.

(21) Appl. No.: 16/799,826

(22) Filed: Feb. 24, 2020

(65) Prior Publication Data

US 2021/0261379 A1 Aug. 26, 2021

(51) Int. Cl.

*B65H 57/04* (2006.01)
*B65H 75/24* (2006.01)
*B65H 18/02* (2006.01)

(52) U.S. Cl.

CPC ..... *B65H 57/04* (2013.01); *B65H 18/02* (2013.01); *B65H 75/242* (2013.01)

(58) Field of Classification Search

CPC .... B65H 16/005; B65H 16/06; B65H 75/406; B65H 2701/1944; B65H 2301/41346; B65H 2402/542; B65H 2402/41; B65H 2404/165; B65H 2402/412; B65H 2301/41308; B65H 23/06; B65H 23/14; B65H 23/1825; B65H 57/04; B65H 75/242; B65H 18/02; B65B 67/08; B65B 67/085; B65B 59/003; B65B 11/02

See application file for complete search history.

(56) References Cited

U.S. PATENT DOCUMENTS

| | | | | |
|---|---|---|---|---|
| 10,059,548 | B2 * | 8/2018 | Chen | B65B 59/04 |
| 10,479,631 | B1 * | 11/2019 | Chen | B65H 16/06 |
| 10,479,632 | B1 * | 11/2019 | Chen | B65B 41/16 |
| 10,479,635 | B1 * | 11/2019 | Chen | B65H 23/1825 |
| 10,994,884 | B2 * | 5/2021 | Voo | B65H 16/005 |
| 2002/0038838 | A1 * | 4/2002 | Marois | B65H 16/06 242/596.6 |
| 2011/0233321 | A1 * | 9/2011 | Chen | B65H 16/005 242/588.2 |
| 2016/0340070 | A1 * | 11/2016 | Chen | B65H 16/005 |
| 2016/0355293 | A1 * | 12/2016 | Clarke | B65B 59/04 |
| 2018/0065827 | A1 * | 3/2018 | Nelson | B65B 67/085 |
| 2020/0039675 | A1 * | 2/2020 | Wolf | B65H 35/002 |
| 2021/0171232 | A1 * | 6/2021 | Kraaijestein | B65B 67/085 |

* cited by examiner

*Primary Examiner* — William A. Rivera
(74) *Attorney, Agent, or Firm* — Bruce Stone LLP; Joseph A. Bruce

(57) ABSTRACT

A scarf-joint structure for the paper tube of a film dispenser is mounted in a film dispenser, which includes a frame connected with a film installation unit and an adjustment unit. The film installation unit is installed with a film roll and consists of a first positioning member and a second positioning member. The adjustment unit is formed with an operating part and a connecting part, and the operating part is connected with an adjusting member, which is threadably fixed with a screw fastener and further, an elastic member is mounted between the operating part and the connecting part. Thus, the film roll, the first positioning member and a second positioning member can be rotated synchronously, able to prevent the film roll from running idle, causing dislocation and falling off.

10 Claims, 9 Drawing Sheets

SCARF-JOINT STRUCTURE FOR THE PAPER TUBE OF A FILM DISPENSER

BACKGROUND OF THE INVENTION

1. Field of the Invention

This invention relates to a film dispenser, particularly to a scarf-joint structure for the paper tube of a film dispenser.

2. Description of the Prior Art

For preventing articles from rocking or dropping out and resulting in damage in the process of storage or transport, a film dispenser is used for packing the articles. The film dispenser includes a frame provided with a film installation unit and a film application unit. The film installation unit is installed with a film roll, and in operation, the film roll is dispensed to stick to the surfaces of the articles and meanwhile, a user uses two hands to hold the film dispenser and quickly have the film wrapped and wound around the surfaces of the articles for carrying out packing operation.

However, since the stationarity between the film installation unit and the film roll is insufficient; therefore, in the process of pulling the film of the film roll, the film roll is apt to run idle and fall off, thus, lowering tension and further, when the film roll needs to be replaced, it will take a longer time in disassembly and assembly of the film roll, inconvenient in use. Therefore, in view of the above-mentioned drawbacks, the inventor of this invention thinks that the conventional film dispenser is necessary to be ameliorated and hence devises this invention.

SUMMARY OF THE INVENTION

The objective of this invention is to offer a scarf-joint structure for the paper tube of a film dispenser, able to prevent a film roll from running idle, causing dislocation and falling off, convenient in adjustment and easy in replacing of the film roll.

The scarf-joint structure for the paper tube of a film dispenser in the prevent invention includes a frame, a film installation unit and an adjustment unit. The frame is formed with an accommodating groove connected with a through hole. The film installation unit contains a first positioning member and a second positioning member, which are provided in the frame. The first positioning member and the second positioning member are respectively provided with a positioning groove, and the positioning groove of the first positioning member or the positioning groove of the second positioning member is provided with a first scarf-joint part. The adjustment unit is formed with an operating part and an extension part. The extension part is fitted with an elastic member and a fixing member, which are received in the accommodating groove. The elastic member has two ends respectively resisting the accommodating groove and the fixing member, and the fixing member is formed with a position-limiting flange and a telescopic part. The telescopic part of the fixing member is inserted out of the through hole, and the extension part is pivotally connected with the first positioning member.

The scarf-joint structure for the paper tube of a film dispenser has the film roll rabbet jointed with the film installation unit by means of both the first scarf-joint part and the second scarf-joint part, thus enabling the film roll, the first positioning member and the second positioning member to be rotated synchronously to prevent the film roll from running idle, causing dislocation and falling off, and further, the operating part of the adjustment unit can be operated to pull up the first positioning member for facilitating adjustment or replacement of the film roll.

BRIEF DESCRIPTION OF DRAWINGS

This invention will be better understood by referring to be accompanying drawings, wherein.

DETAILED DESCRIPTION OF THE PREFERRED EMBODIMENT

Figure 1:
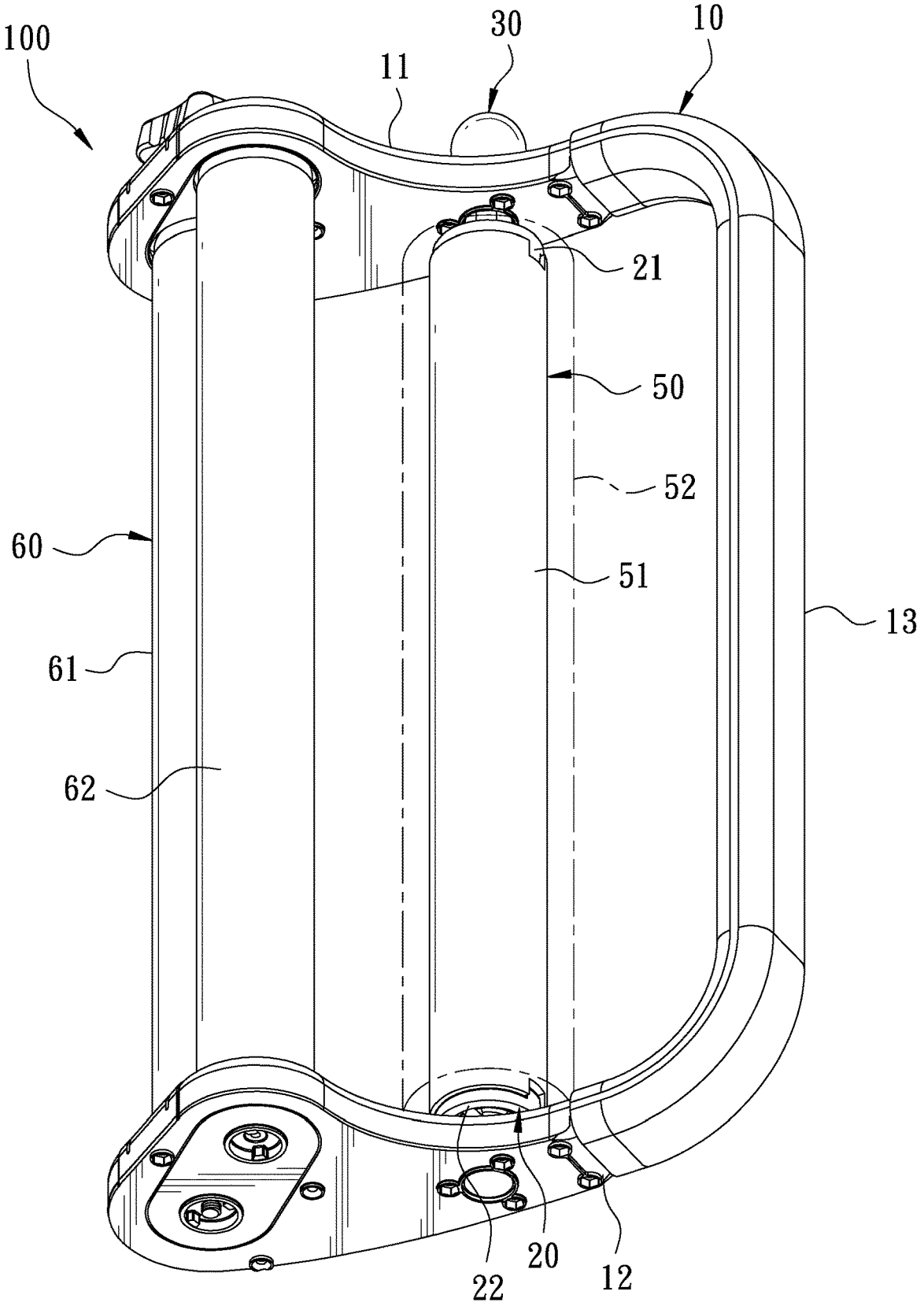
FIG. 1 is a perspective view of a first preferred embodiment of a scarf-joint structure for the paper tube of a film dispenser in the present invention.
Figure 2:
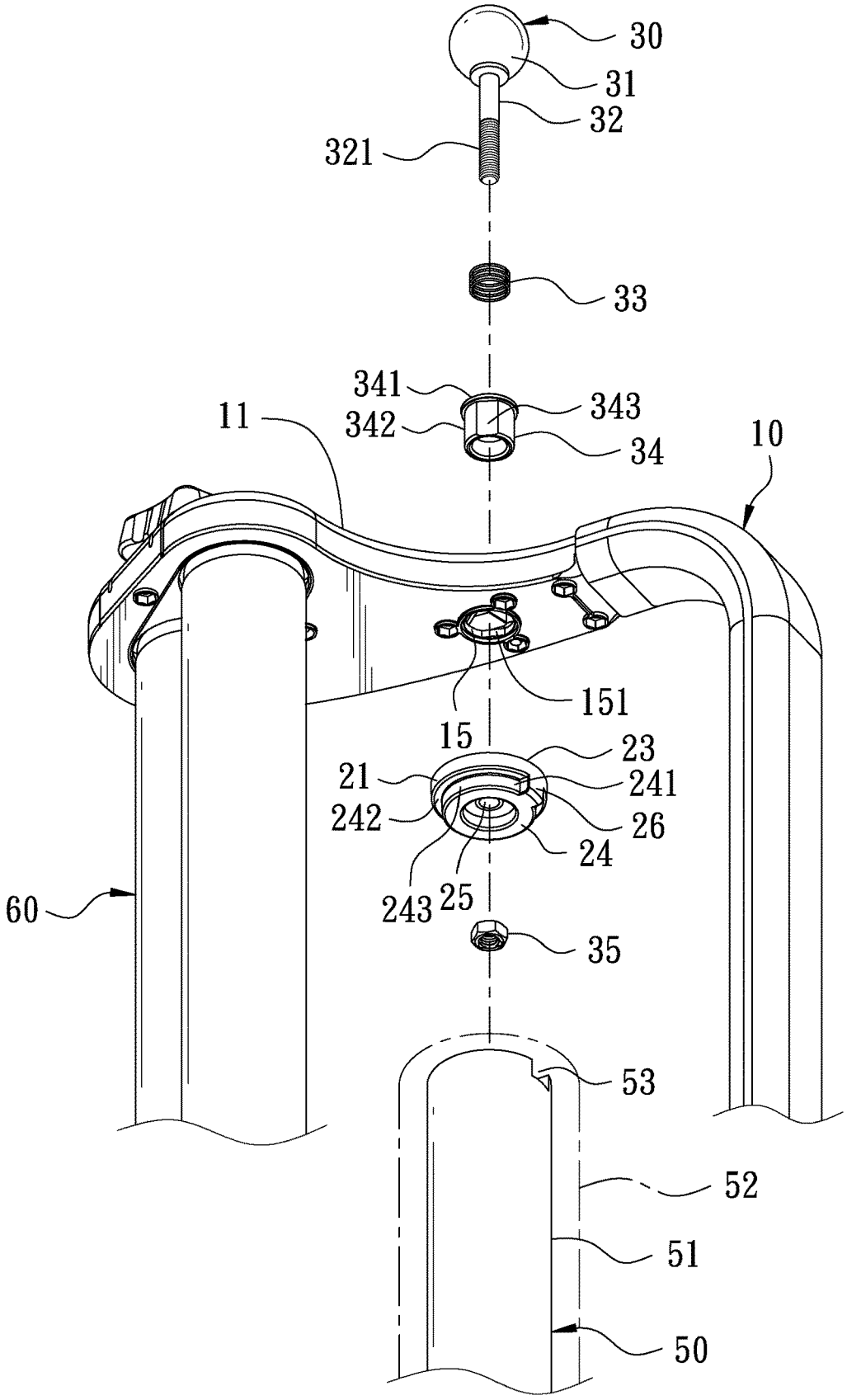
FIG. 2 is a partial exploded perspective view of the first preferred embodiment of the scarf-joint structure for the paper tube of a film dispenser in the present invention, showing an exploded perspective form of a first positioning member and an adjustment unit.
Figure 3:
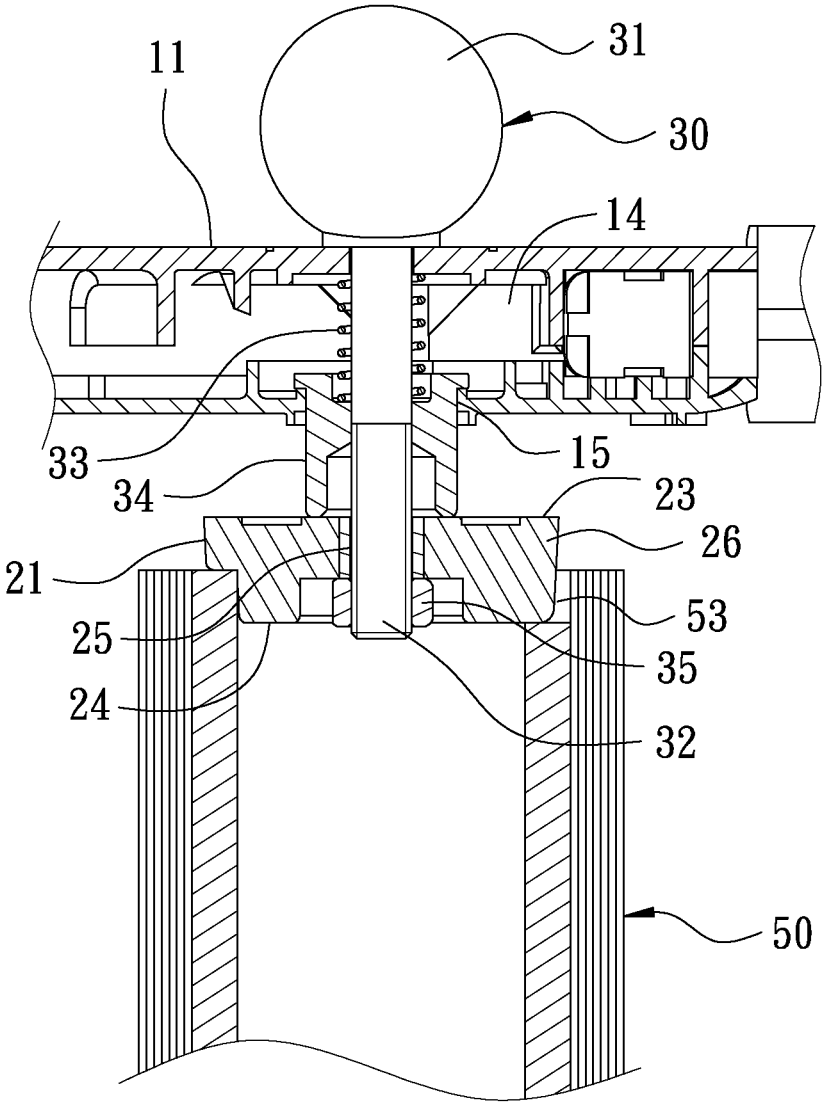
FIG. 3 is a partial cross-sectional view of the first preferred embodiment of the scarf-joint structure for the paper tube of a film dispenser in the present invention.

A first preferred embodiment of a scarf-joint structure for the paper tube of a film dispenser in the present invention in is provided in the film dispenser that includes a frame 10, a film installation unit 20, an adjustment unit 30, a fixing unit 40, a film roll 50 and a film application unit 60 as main components combined together.

The frame 10 is formed with a top seat 11, a bottom seat 12 and a rod 13 connected between the top seat 11 and the bottom seat 12. The top seat 11 is formed with an accommodating groove 14 connected with through hole 15, which is a round hole in this preferred embodiment. Further, two position-limiting blocks 151 spaced apart are disposed at the location of the through hole 15 of the top seat 11.

The film installation unit 20 contains a first positioning member 21 and a second positioning member 22, the first positioning member 21 provided at the top seat 11 while the second positioning member is positioned at the bottom seat 12. The first positioning member 21 and the second positioning member 22 are somewhat disc-shaped and respectively formed with a first surface 23 and a second surface 24 opposite to each other, with first surface 23 and the second surface 24 jointly bored with an insert hole 25. Further, the second surface 24 has an outer circumference bored with a positioning groove 241 enabling the first positioning member 21 and the second positioning member 22 to be defined to have a bottom wall 242 and a side wall 243. The bottom wall 242 is provided with a first scarf-joint part 26 extending toward the outer circumference of both the first positioning member 21 and the second positioning member 22. In this preferred embodiment, the positioning groove 241 is C-shaped, and the first scarf-joint part 26 is a rectangular protruding block.

The adjustment unit 30 is connected with the top seat 11 and formed with an operating part 31 and an extension part 32. The operating part 31 is somewhat spherical for facilitating operation, and the extension part 32 is a rod. The extension part 32 is provided with a threaded section 321 at one end far away from the operating part 31, and the extension part 32 is fitted thereon with an elastic member 33 and a fixing member 34, which are received in the accommodating groove 14. In this preferred embodiment, the elastic member 33 is a spring, which has two ends respectively resisting against the accommodating groove 14 and the fixing member 34. The fixing member 34 is threadably secured with threaded section 321, and formed with a position-limiting flange 341 and a telescopic part 342. The position-limiting flange 341 can resist against the wall of the accommodating groove 14, while the extension part 342 is cylindrical and has its outer circumference provided with two position-limiting grooves 343 spaced apart for the position-limiting block 151 to be positioned therein. The telescopic part 342 of the fixing member 34 can be inserted out of the through hole 15 of the top seat 11, and the threaded section 321 of the extension part 32 is inserted through the top seat 11 and the fixing member 34 and the insert hole 25 of the first positioning member 21 and then secured with a screw fastener 35 located at the insert hole 25 of the first positioning member 21.

Figure 4:
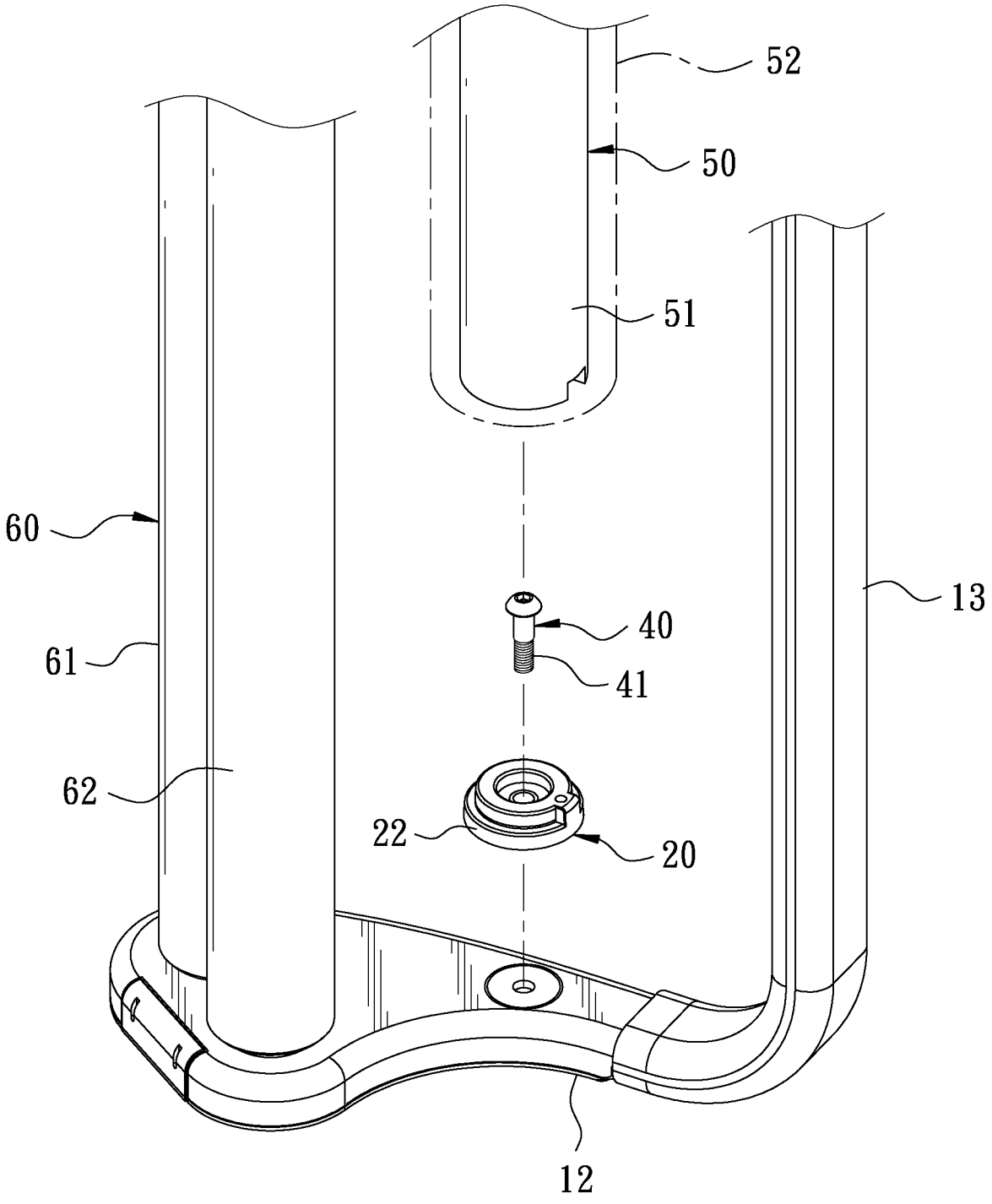
FIG. 4 is a partial exploded perspective view of the first preferred embodiment of the scarf-joint structure for the paper tube of a film dispenser in the present invention.
Figure 5:
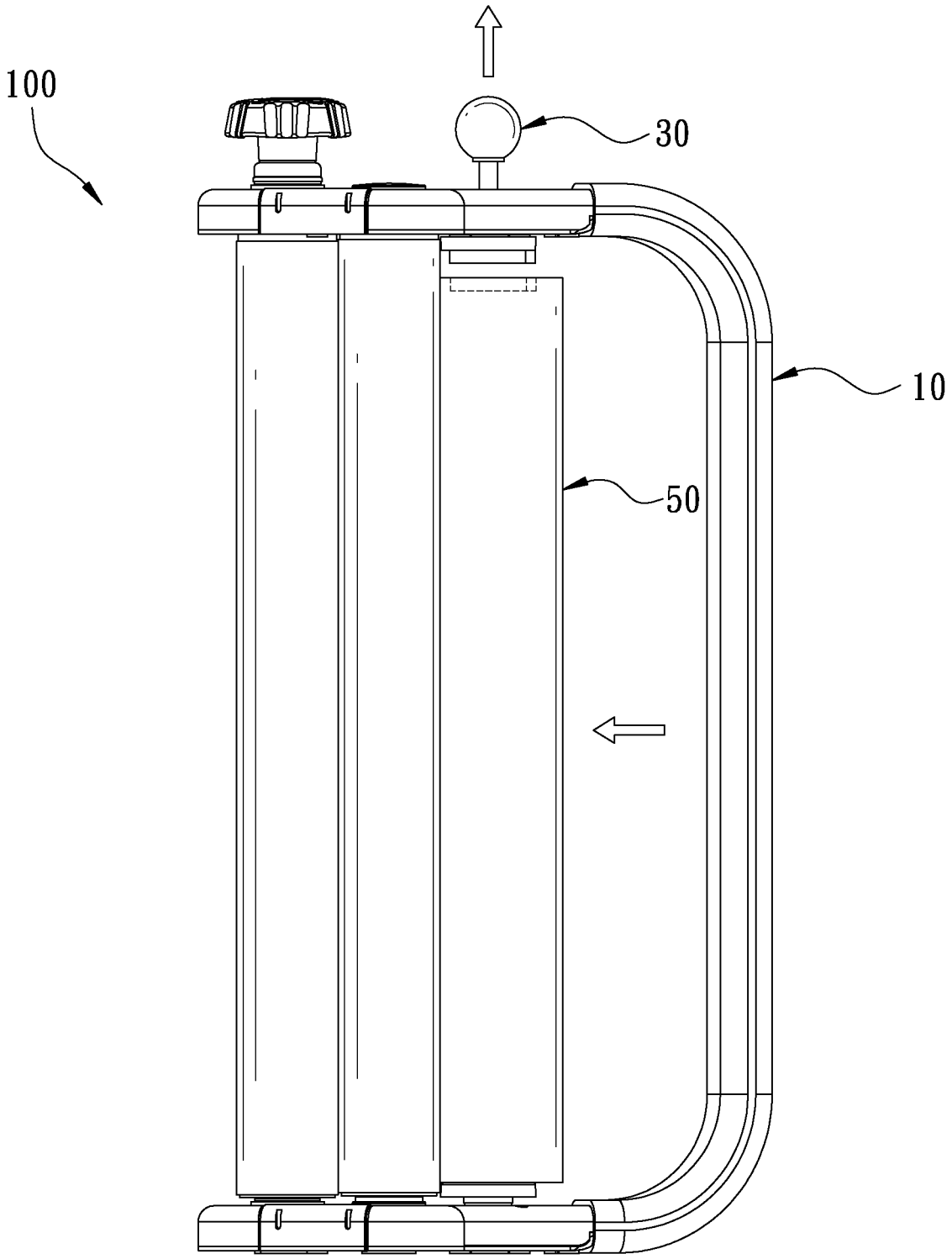
FIG. 5 is a schematic view of the first preferred embodiment of the scarf-joint structure for the paper tube of a film dispenser in use in the present invention.

The fixing unit 40, as shown in FIG. 4, is formed with a fixed shaft 41, which has one end pivotally connected with the second positioning member 22 and another end fixed in the bottom seat 12.

The film roll 50 has two ends respectively rabbet jointed with the first positioning member 21 and the second positioning member 22, containing a hollow paper tube 51 and film 52 wound around the paper tube 51. The paper tube 51 has two ends of its major axis respectively provided with a second scarf-joint part 53 corresponding to the first scarf-joint parts 26. In this preferred embodiment, the second scarf-joint part 53 is a rectangular recess so that the two second scarf-joint parts 53 can be respectively rabbet combined with the first scarf-joint parts 26 to enable the film roll 50, the first positioning member 21 and the second positioning member 22 to be rotated synchronously and prevent the film roll 50 from running idle, causing dislocation and falling off.

The film application unit 60 consists of a first roller 61 and a second roller 62, which have two end respectively connected with the top seat 11 and the bottom seat 12 for dispensing the film 52 of the film roll 50.

In use of the film dispenser 100, referring to FIGS. 2, 3, 4 and 5, firstly, the second scarf-joint parts 53 of the film roll 50 are respectively aligned to the first scarf-joint part 26 of the first positioning member 21 and the first scarf-joint part 26 of the second positioning portion 22. At this time, a user can hold the operating part 31 and pull it upward to let the screw fastener 35 actuate both the first positioning member 21 and the fixing member 34 to move upward and compress the elastic member 33, letting the first positioning member 21 moved upward axially and thus. the space between the first positioning member 21 and the second positioning member 22 can the increased, and the film roll 50 can be easily and quickly positioned with both the first positioning member 21 and the second positioning member 22 and then release the operating part 31 to complete assembly of the film roll 50. Subsequently, the film 52 of the film roll 50 is pulled to pass through the first roller 61 and the second roller 62 and meanwhile, two sides of the film 52 are pulled outward along the surfaces of both the first roller 61 and the second roller 62 for straightening the film 52 of the film roll 50 so that the film 52 of the film roll 50 can be tightly stuck and covered on the outer sides of the articles, thus finishing packing operation.

Since the first scarf-joint part 26 and the second scarf-joint part 53 are mutually rabbet jointed; therefore, the film roll 50 and both the first positioning member 21 and the second positioning member 22 can be actuated to rotate synchronously, able to maintain continuity of dispensing film. Further, when the film roll 50 is in a scarf-joint state, the elastic member 33 will push both the fixing member 34 and the first positioning member 21 to tightly clamp the film roll 50 to enable the film 52 pulled to create tension, able to increase integrity and coverture of packing. Furthermore, the first scarf-joint part 26 and the second scarf-joint part 53 provided in this invention can restrict the film roll 50 installed in the film installation unit 20, thus achieving effect of special purpose.

In the first preferred embodiment of this invention, both the first positioning member 21 and the second positioning member 22 are respectively provided with the first scarf-joint part 26, but either the first positioning member 21 or the second positioning member 22 may also be provided with the first scarf-joint portion independently.

Figure 6:
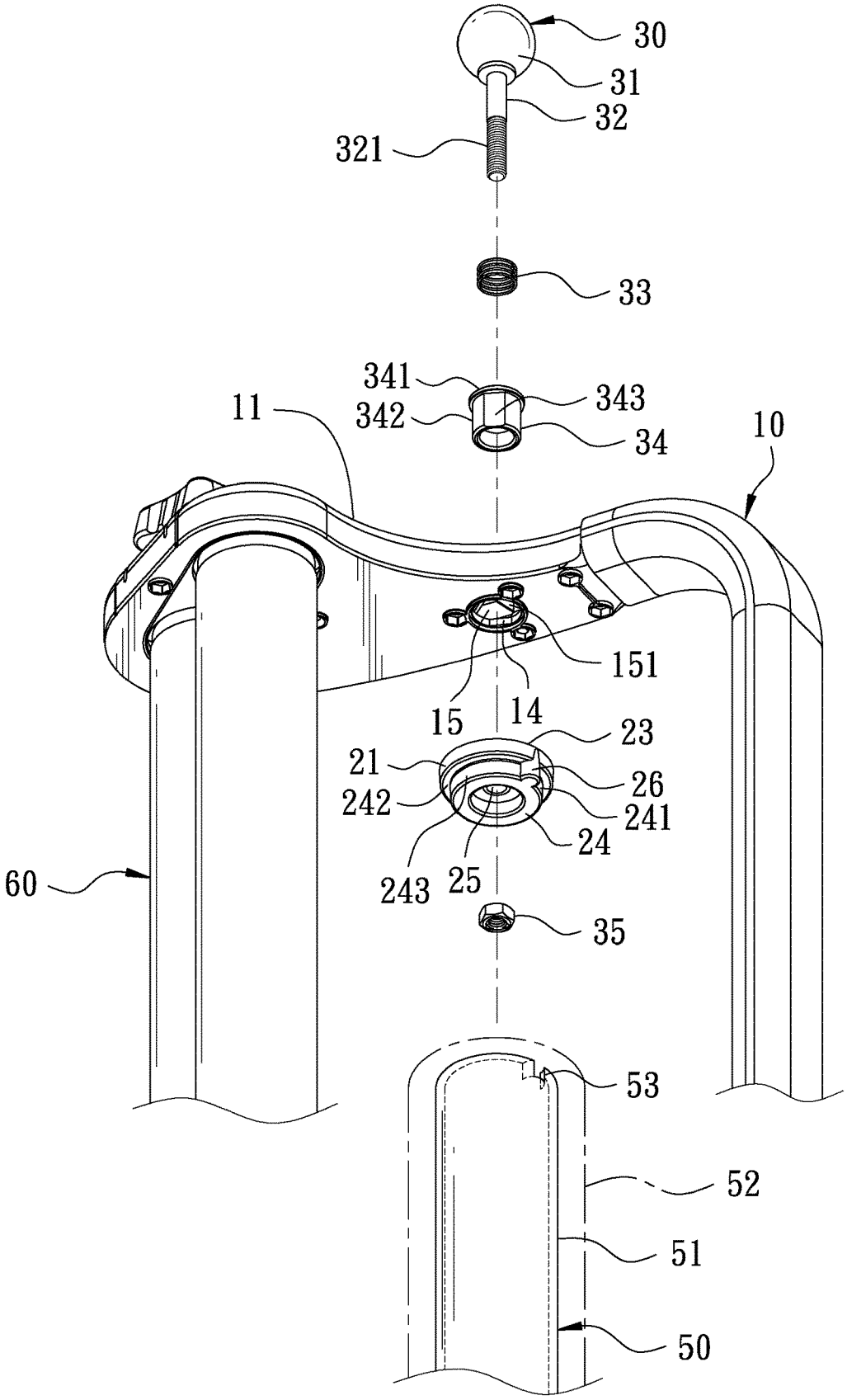
FIG. 6 is a partial exploded perspective view of a second preferred embodiment of a scarf-joint structure for the paper tube of a film dispenser in the present invention, showing a second form of a first scarf-joint part and a second scarf-joint part.

At second preferred embodiment of a scarf-joint structure for the paper tube of a film dispenser in the present invention, as shown in FIG. 6, is to change the form of both the first scarf-joint part 26 and the second scarf-joint part 53. In the second preferred embodiment, the first scarf-joint part 26 is a semi-cylindrical protruding block, and the second scarf-joint part 53 is a semi-cylindrical recess. Thus, the second scarf-joint parts 53 can be respectively rabbet combined with the corresponding first scarf-joint part 26, able to increase scarf-joint function and enhance effect of synchronous rotation.

Figure 7:
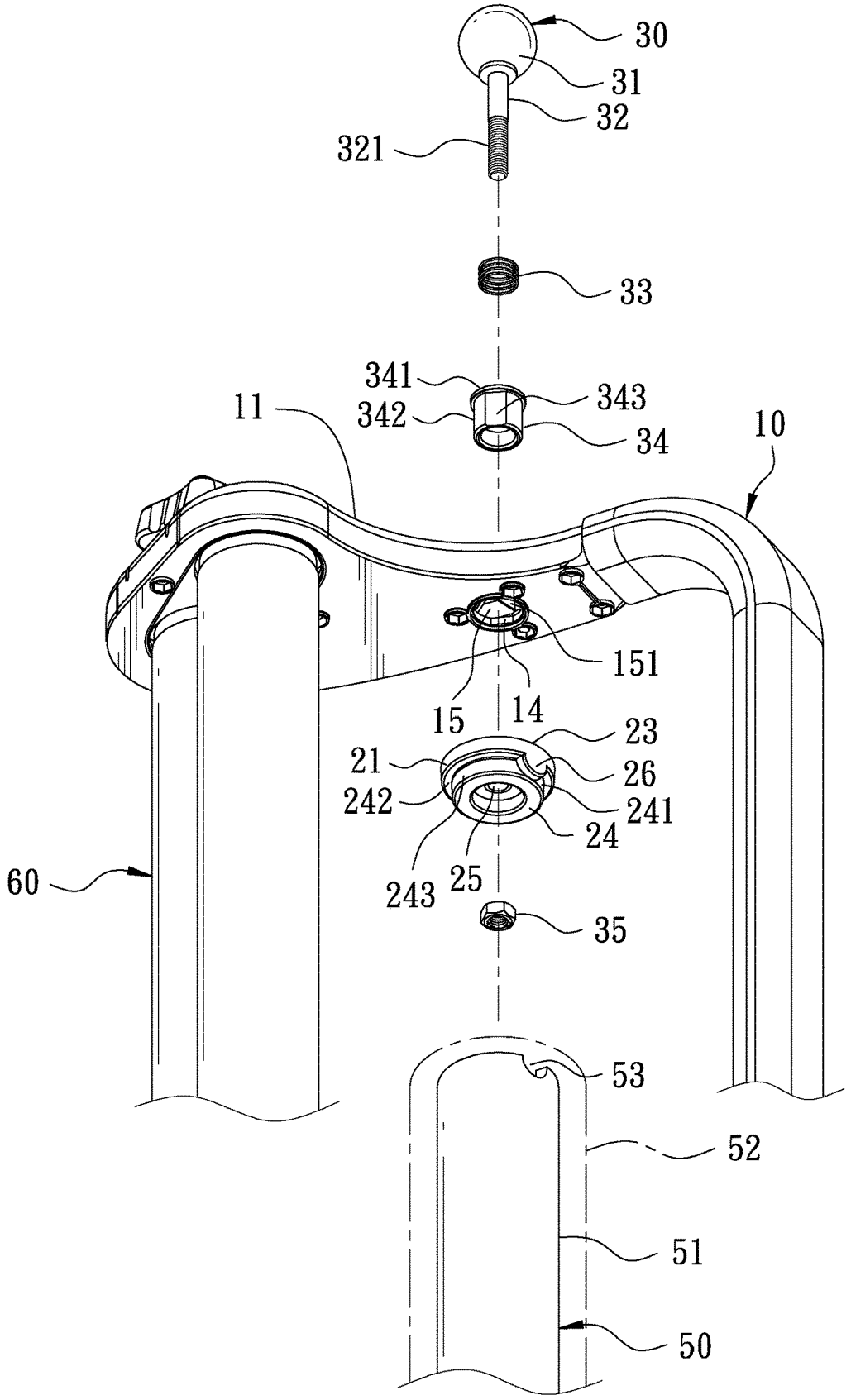
FIG. 7 is a partial exploded perspective view of a third preferred embodiment of a scarf-joint structure for the paper tube of a film dispenser in the present invention, showing a third form of the first scarf-joint part and the second scarf-joint part.

A third preferred embodiment of a scarf-joint structure for the paper tube of a film dispenser in the present invention, as shown in FIG. 7, is to have the form of both the first scarf-joint part 26 and the second scarf-joint part 53 changed. In the third preferred embodiment, the first scarf-joint part 26 is an arcuate protruding block, and the second scarf-joint part 53 is an arcuate recess, able to replace the film roll 50, achieving guidance function and increasing effect of replacement.

Figure 8:
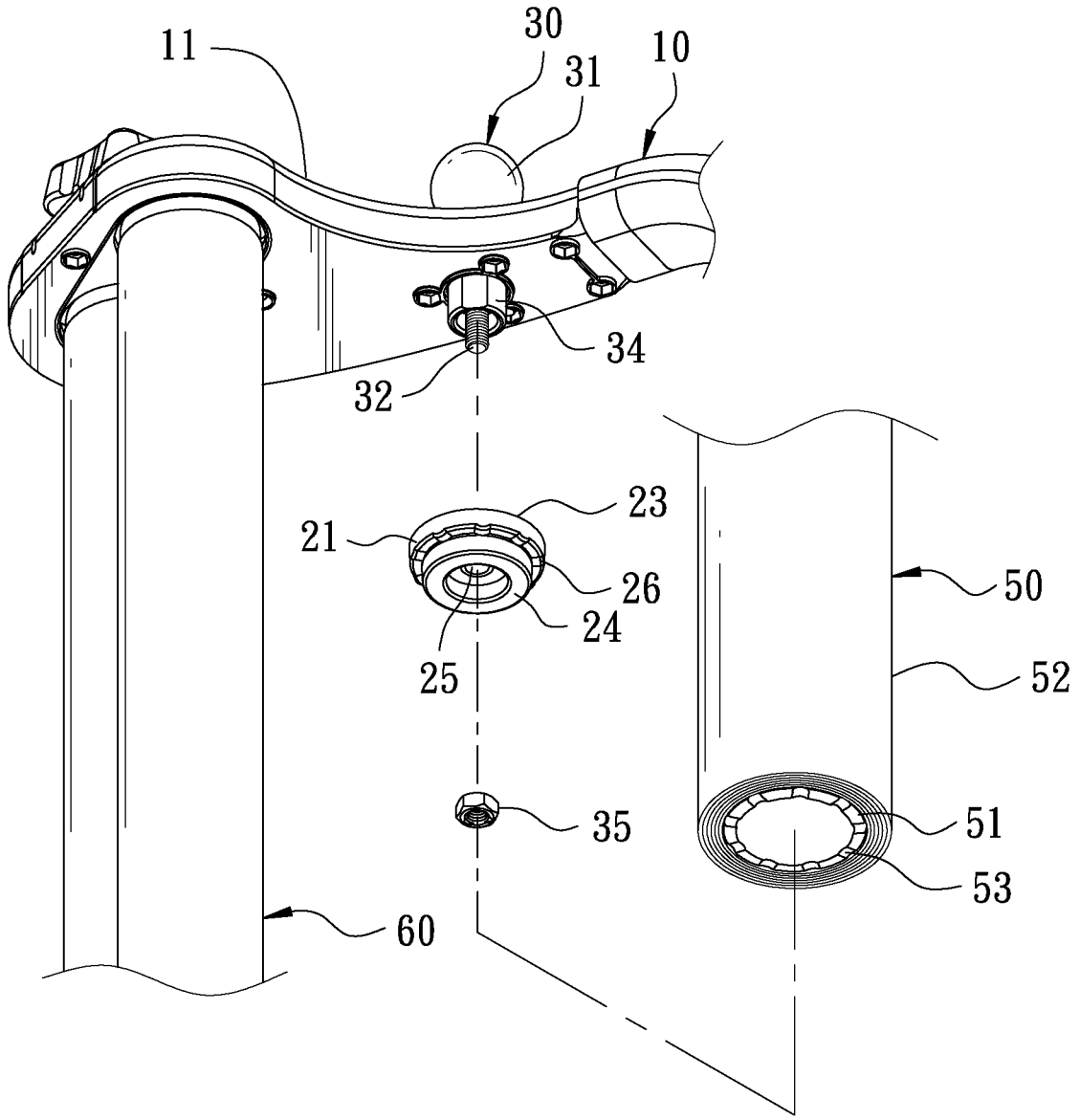
FIG. 8 is a partial exploded perspective view of a fourth preferred embodiment of a scarf-joint structure for the paper tube of a film dispenser in the present invention, showing a fourth form of the first scarf-joint part and the second scarf-joint part.

A fourth preferred embodiment of a scarf-joint structure for the paper tube of a film dispenser in the present invention, as shown in FIG. 8, is to have the first scarf-joint part 26 and the second scarf-joint part 53 altered in form. Different from the third preferred embodiment, the fourth preferred embodiment has the first positioning member 21 and the second positioning member 22 respectively provided with a plurality of the first scarf-joint parts 26, which are arcuate protruding blocks, and the film roll 50 is provided with a plurality of second scarf-joint parts 53, which are arcuate recesses. Thus, the second scarf-joint parts 53 can quickly be rabbet jointed with the first scarf-joint parts 26, and in the rotation process of the film roll 50, the first positioning member 21 and the second positioning member 22 can be stressed evenly, able to enhance fluency of dispensing the film roll 50.

Figure 9:
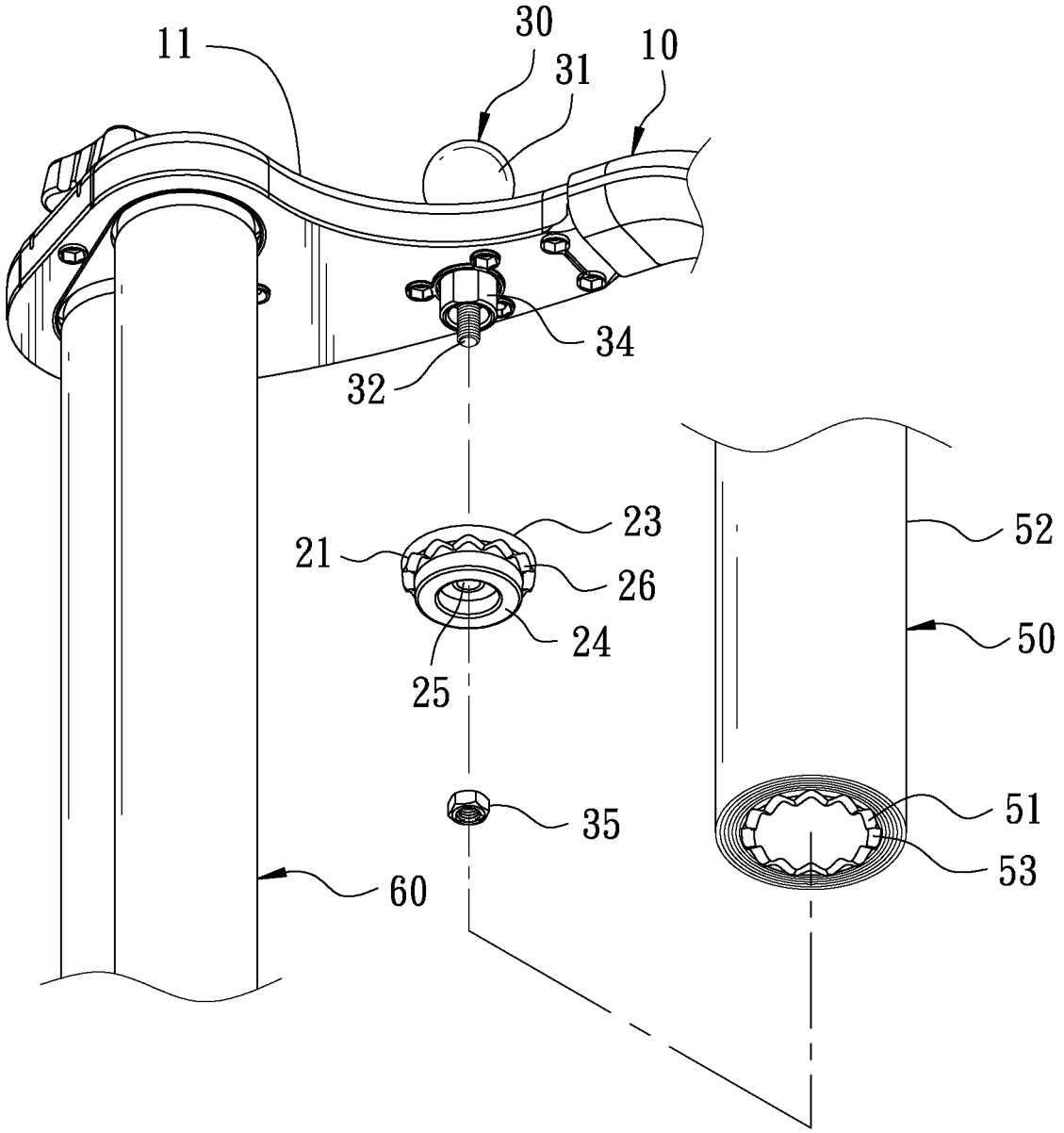
FIG. 9 is a partial exploded perspective view of a fifth preferred embodiment of a scarf-joint structure for the paper tube of a film dispenser in the present invention, showing a fifth form of the first scarf-joint part and the scarf-joint part of the paper tube.

A fifth preferred embodiment of a scarf-joint structure for the paper tube of a film dispenser in the present invention, as shown in FIG. 9, is different from the fourth preferred embodiment in the form of both the first scarf-joint part and the second scarf-joint part. In the fifth preferred embodiment, the first scarf-joint parts 26 are triangular protruding blocks and a recess is formed between every two scarf-joint parts 26, and the second scarf-joint parts 53 are triangular recesses and a bulgy portion is formed between every two scarf-joint parts 53. Thus, when the second scarf-joint parts 53 are rabbet jointed with the first scarf-joint parts 26, the first positioning member 21 and the second positioning member 22 can be stressed evenly and the film roll 50 can be dispensed more fluently.

While the preferred embodiments of the invention have been described above, it will be recognized and understood that various modifications may be made therein and the appended claims are intended to cover all such modifications that may fall within the spirit and scope of this invention.

What is claimed is:

1. A scarf-joint structure for the paper tube of a film dispenser comprising:

a frame formed with an accommodating groove, said accommodating groove connected with a through hole;

a film installation unit comprising a first positioning member and the second positioning member, said first positioning member and said second positioning member provided at said frame, said first positioning member and said second positioning member respectively formed with a positioning groove, said positioning groove of said first positioning member, or said positioning groove of said second positioning member provided with a first scarf-joint part; and an adjustment unit formed with an operating part and an extension part, said extension part fitted with an elastic member and a fixing member, said elastic member and said fixing member received in said accommodating groove, said elastic member having two ends respectively resisting said accommodating groove and said fixing member, said fixing member formed with a position-limiting flange and a telescopic part, said telescopic part of said fixing member inserted out of said through hole, said extension part pivotally connected with said positioning member.

2. The scarf-joint structure for the paper tube of a film dispenser as claimed in claim 1, wherein said film installation unit is installed with a film roll, said film roll provided with a second scarf-joint part, said second scarf-joint part able to be rabbet jointed with said first scarf-joint portion.

3. The scarf-joint structure for the paper tube of a film dispenser as claimed in claim 2, wherein said frame is formed with a top seat and a bottom seat, said top seat formed with said accommodating groove, said first positioning member provided at said top seat, said second positioning member positioned at said bottom seat, said first positioning member and said second positioning member respectively and oppositely formed with a first surface and second surface, said second surface bored with said positioning groove, each said positioning groove disposed with said first scarf-joint part, said film roll having two ends respectively provided with said second scarf-joint part.

4. The scarf-joint structure for the paper tube of a film dispenser as claimed in claim 3, wherein said positioning groove is C-shaped, said first scarf-joint part is a rectangular protruding block and said second scarf-joint part is a rectangular recess.

5. The scarf-joint structure for the paper tube of a film dispenser as claimed in claim 3, wherein said first scarf-joint part is a semi-cylindrical protruding block, and said second scarf-joint part is a semi-cylindrical recess.

6. The scarf-joint structure for the paper tube of a film dispenser as claimed in claim 3, wherein said first scarf-joint part is an arcuate protruding block, and said second scarf-joint part is an arcuate recess.

7. The scarf-joint structure for the paper tube of a film dispenser as claimed in claim 3, wherein said first positioning member and said second positioning member are respectively formed with a plurality of said first scarf-joint parts, and said first scarf-joint parts are arcuate protruding blocks, said film roll provided with a plurality of said second scarf-joint parts, said second scarf-joint parts being arcuate recesses.

8. The scarf-joint structure for the paper tube of a film dispenser as claimed in claim 3, wherein said first positioning member and said second positioning member are respectively formed with a plurality of said first scarf-joint parts, and said first scarf-joint parts being rectangular protruding blocks, a recess formed between every two said first scarf-joint parts, said second scarf-joint parts being rectangular recesses, a bulgy part formed between every two said second scarf-joint parts.

9. The scarf-joint structure for the paper tube of a film dispenser as claimed in claim 1, wherein said extension part is provided with a threaded section at one end far away from said operating part and said fixing member is screwed with said threaded section, said threaded section inserted through said top seat and said fixing member and through said first positioning member and then threadably fixed with screw fastener.

10. The scarf-joint structure for the paper tube of a film dispenser as claimed in claim 1, wherein said through hole is a round hole, and said top seat is provided with two position-limiting blocks spaced apart at a location of said through hole, said telescopic part having an outer circumference provided with two position-limiting grooves spaced apart, said position-limiting block positioned in said position-limiting groove.

* * * * *